US005366010A

United States Patent [19]

Zwart

[11] Patent Number: 5,366,010

[45] Date of Patent: Nov. 22, 1994

[54] RETRIEVABLE BRIDGE PLUG AND A RUNNING TOOL THEREFOR

[76] Inventor: Klaas J. Zwart, Drumgarth, Inchgarth Road, Cults, Aberdeen AB1 9NX, United Kingdom

[21] Appl. No.: 129,100

[22] PCT Filed: Apr. 3, 1992

[86] PCT No.: PCT/GB92/00605

§ 371 Date: Oct. 5, 1993

§ 102(e) Date: Oct. 5, 1993

[87] PCT Pub. No.: WO92/17681

PCT Pub. Date: Oct. 15, 1992

[30] Foreign Application Priority Data

Apr. 6, 1991 [GB] United Kingdom ..... 9107282

[51] Int. Cl.[5] ..... E21B 23/00

[52] U.S. Cl. ..... 166/120; 166/123

[58] Field of Search ..... 166/120–125, 166/134, 209, 369, 386, 387, 381

[56] References Cited

U.S. PATENT DOCUMENTS

| | | | |
|---|---|---|---|
| 4,432,418 | 2/1984 | Mayland | 166/123 X |
| 4,688,634 | 8/1987 | Lustig et al. | 166/123 X |
| 4,832,129 | 5/1989 | Sproul et al. | 166/123 X |

*Primary Examiner*—Michael Powell Buiz
*Attorney, Agent, or Firm*—Bell Seltzer Park

[57] ABSTRACT

A tool for downhole use in oil and gas wells comprises a number of relatively-axially-slidable members. Upper and lower toothed locking slips are mounted on respective upper and lower members and a resilient ring member is mounted on a further member between the locking slips and is compressible into sealing engagement with a bore wall on relative movement of the slips towards each other. The locking slips are moved into radially extended bore wall engaging positions by relative axial movement of the respective members and the central member. The upper and lower locking slips are extended by application of downward force to the central member and the upper member, respectively, and the ring member is compressed into sealing engagement with the bore wall by application of an upward force to the lower member.

21 Claims, 7 Drawing Sheets

RETRIEVABLE BRIDGE PLUG AND A RUNNING TOOL THEREFOR

Figure 1:
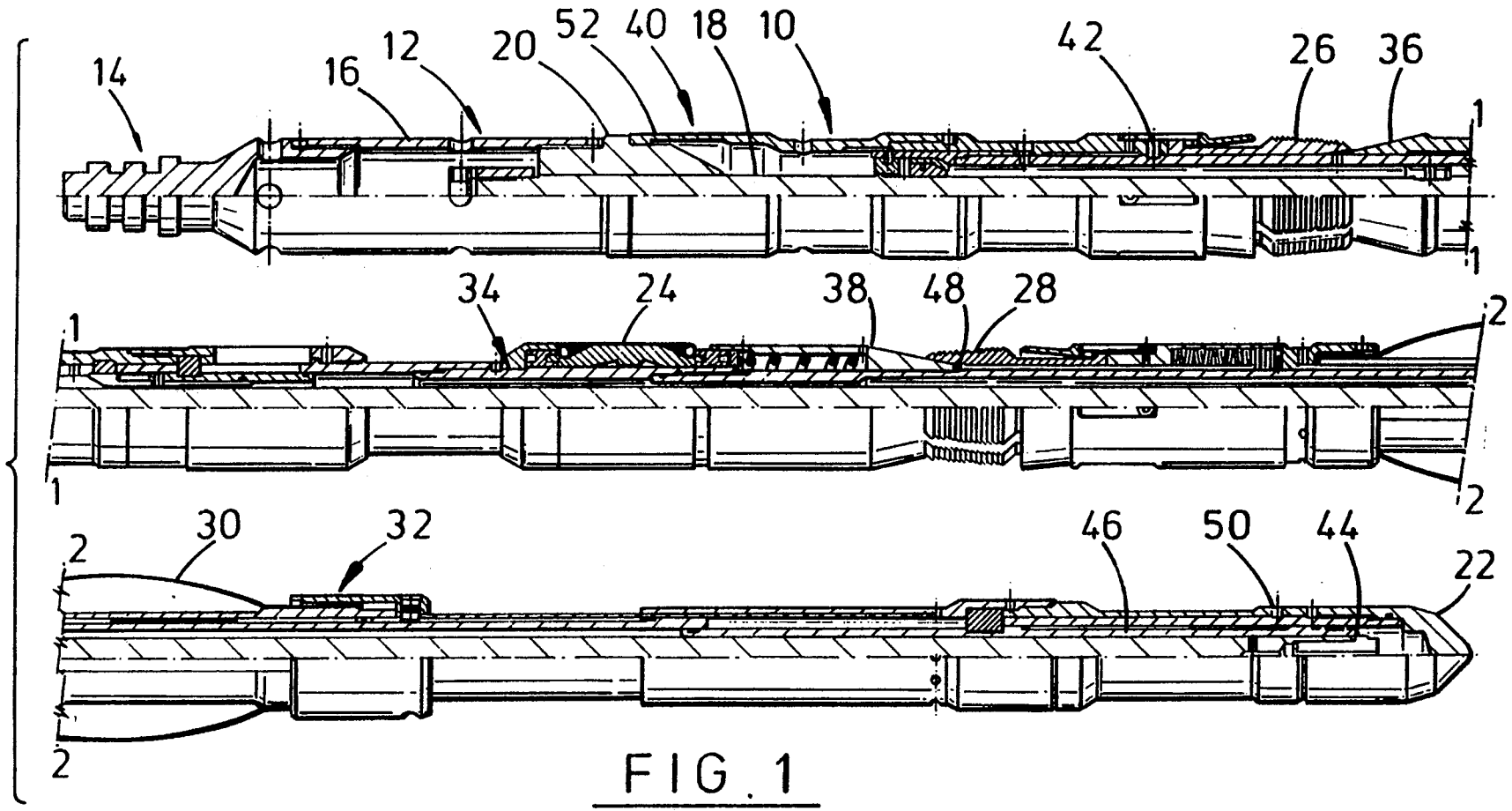
Figure 2A:
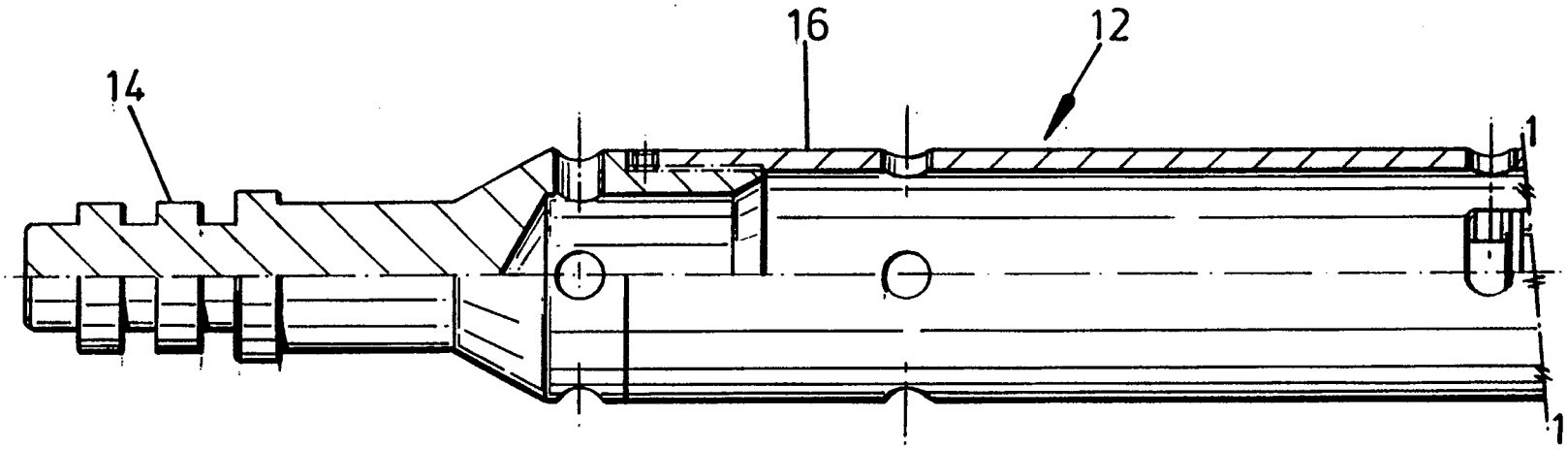
Figure 2B:
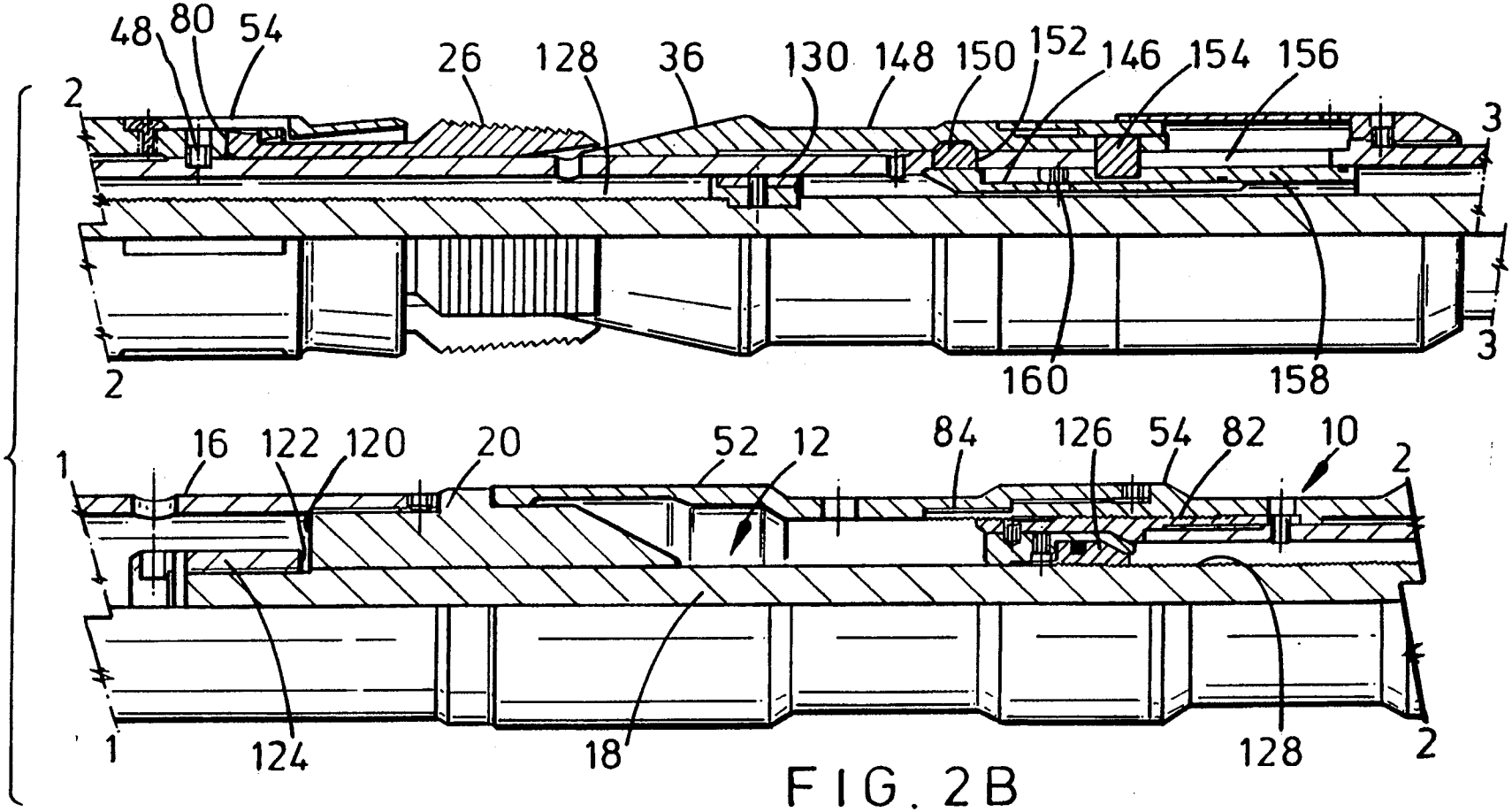
Figure 2C:
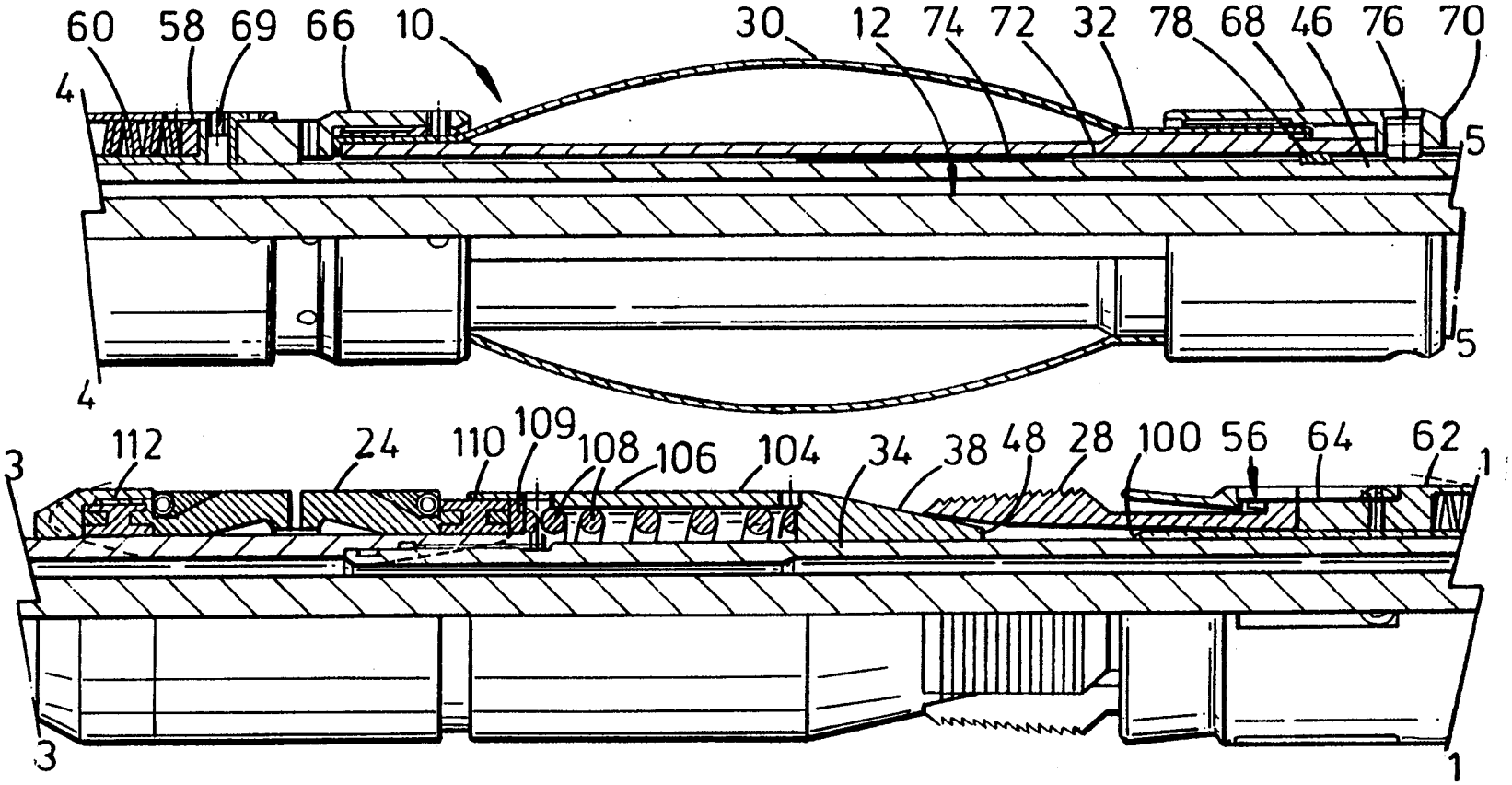
Figure 2D:
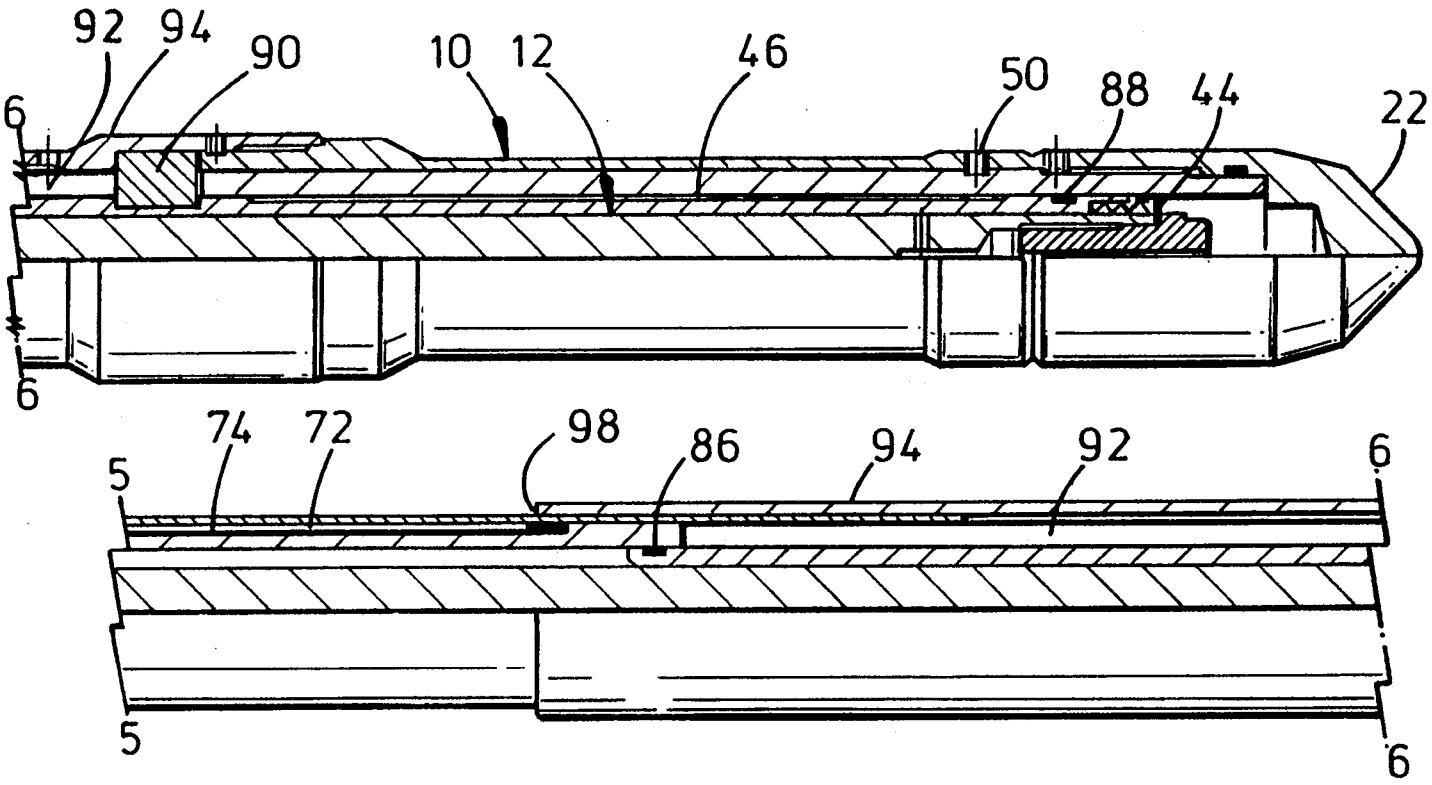

This invention relates to tools for downhole use in oil and gas wells and in particular, but not exclusively, to retrievable bridge plugs and running tools therefor. The invention also relates to fishing tools for retrieving such plugs from oil wells.

Bridge plugs are widely used in the oil and gas exploration and extraction industries and are run downhole from the surface for setting in a string of pipe. Bridge plugs may be used to seal a portion of pipe to permit the integrity of the pipe to be checked using pressure testing, to act as a barrier within the pipe to seal the well, or to act as a carrier for downhole monitoring equipment. Conventional bridge plugs, and many other downhole tools, are located in the pipe bore by running a lock provided on the plug into a slot or recess in the pipe string, the locations of such recesses being identified by locating shoulders, commonly known as landing nipples. A string of pipe may have several landing nipples over the length of the pipe, each nipple producing a step down in diameter. This leads to a restriction on the diameter of the lower sections of the pipe reducing the flow area through the pipe. Such landing nipples may also become worn through use and may also be "washed out" by the flow of abrasive fluid past the restriction. Repair of the landing nipples requires pulling and replacement of the pipe string.

Conventional bridge plugs require considerable forces to be used in setting the bridge plug in the pipe, and in particular in providing a seal between the exterior of the plug body and the pipe wall. The magnitude of the necessary setting forces is such that conventional wirelines and slick lines are not capable of providing the necessary force such that explosive charges must be provided in the bridge plug, the charges acting on hydraulic fluid to provide the necessary locking and sealing forces. Detonation of the charge is achieved through use of an electric line extending from the surface. While the locking arrangement achieved through use of such explosive charges is generally satisfactory, the use of such charges requires the presence of specially skilled and licensed operators and normally require the imposition of "radio silence" during the setting operation to minimise the risk of the charge being accidentally set off. For many operations, particularly offshore, the requirement for such radio silence may effectively bring all other work on the rig which involves sending of signals to a halt.

It is among the objects of the present invention to provide tools which obviate and mitigate these disadvantages. In particular, it is an object of one aspect of the the present invention to provide a downhole tool which may be set in sealing engagement with a bore or pipe wall using only a wireline or slick line connection to the surface. It is a further object of another aspect of the present invention to provide a downhole tool which may be set at any desired depth in a pipe or bore without relying on a shoulder or landing nipple on the well.

One aspect of the present invention provides a tool a tool for downhole use in oil and gas wells comprising: a body having first and second locking means moveable between a retracted configuration to permit movement of the tool through a bore and a radially extended configuration for locking engagement with a bore wall, the first locking means being mounted on a locking assembly via biasing means; a resilient ring member between the locking means and compressible into sealing engagement with a bore wall by relative axial movement of the locking means towards each other and at least the first locking means being moveable axially on the body to provide compression of the ring member; and cam means between the ring member and the first locking means for extending the first locking means from the retracted configuration into the extended configuration, the setting force to compress the ring member into engagement with the bore wall being applied via the locking assembly and the cam means, the proportion of said setting force transmitted to said first locking means being limited by said biassing means.

The tool may be in the form of a bridge plug, a packer, an annular safety valve, a pack off tool and the like in which sealing of the well is desired.

This arrangement reduces the force which must be applied to the locking assembly in order to provide the necessary compression of the ring member as the force is not applied through the locking means which are in engagement with the bore wall and thus have to De pushed across the bore wall in order to compress the ring member. Further, the provision of the biasing means allows the locking means to retract slightly on movement of the locking assembly and then extend when the setting force is removed or reduced. Thus, the locking means may effectively act as a ratchet against the bore wall.

Another aspect of the present invention provides a tool a tool for downhole use in oil and gas wells comprising: a body having first and second locking means moveable between a retracted configuration to permit movement of the tool through a bore and a radially extended configuration for locking engagement with a bore wall; a resilient ring member located between the locking means and compressible into sealing engagement with a bore wall by relative axial movement of the locking means towards each other; first and second cam means mounted on the body between the ring member and the respective locking means for extending the respective locking means from the retracted configuration into the extended configuration on axial movement of the locking means towards the ring member; and release means arranged for engagement with a fishing tool and operable thereby to permit movement of the second cam means relative to the second locking means sufficient to permit said second locking means to retract from the extended configuration and to permit expansion of the ring member out of sealing engagement with the bore wall.

The release of the second locking means and the ring member also facilitates retraction of the first locking means to allow retrieval of the tool and, in use, the tool may be retrieved from the well bore after operation of the release means.

Preferably, resilient means are provided for biasing the cam means axially towards the respective locking means and thus maintaining the locking means in the extended configuration. The resilient means may take the form of a compression spring located between one of the cam means and the ring member. Most preferably, the locking means are in the form of sets of toothed slips, a lower set of slips resisting downward movement and an upper set to slips resisting upward movement. With this arrangement, the slips act as ratchets to maintain the resilient ring member in the compressed state with the ring member and the resilient means providing a reaction force to maintain the slips in the extended configuration.

In a preferred configuration the body includes first, second and third members, the first locking means and the locking assembly being mounted to the first member, the resilient ring member and the cam means being mounted to the second member and the second locking means being mounted to the third member. When setting the tool the second member is initially moved downwardly relative to the first member by downward force applied to the second member to extend the first locking means into engagement with the bore wall. The third member is then moved downwardly relative to the second member by application of a downward force to the third member to extend the second locking means into engagement with the bore wall. Finally, the first member is moved upwardly relative to the second member by application of an upward force to the first member to compress the sealing ring into sealing engagement with the bore wall. To ensure the correct sequence of relative movement the second and third members may be releasably interconnected by, for example, shear pins to prevent movement therebetween prior to extension of the first locking means. Further, the second and third members may be further connected by ratchet means for locking the third member relative to the second member and thereby locking the second locking means in the extended configuration. Clearly, the tool may also be operated in the alternative orientation such that, for example, the first locking means are set by applying an upward force to the second member to produce upward movement relative to the first member.

In accordance with a further aspect of the present invention there is provided a tool for downhole use in oil and gas wells comprising axially-relatively-slidable first and second members and coupling means interconnecting the members. The first members have engagement means for frictionally engaging a bore wall as the tool is lowered down a well and locking means moveable between a retracted configuration and a radially extended configuration for locking engagement with a bore wall to restrict at least downward movement of the first member relative thereto, the second member having cam means arranged for extending the locking means from the retracted configuration on downward axial movement of the second member relative the first member. The coupling means has a first configuration for use when lowering the tool into a well in which the relative downward axial movement is prevented and a second configuration in which the relative downward axial movement is permitted, the engagement means providing sufficient grip with the bore wall when the has reached a desired depth to hold the first member relative to the bore to permit the relative movement on application of a downward force to the second member. Movement of the coupling means from the first configuration to the second configuration is produced by upward axial movement of the second member relative to the first member.

Thus, the change in configuration of the coupling means may be achieved solely by means of upward axial movement of the second member relative to the first member, and thus may utilise conventional slick line or wireline connection to the surface. Further, the provision of the engagement means allows the tool to be located at any desired depth without relying upon the presence of shoulders or landing nipples.

Preferably, the coupling means includes a sleeve located between the first and second members and axially fixed relatively to the second member and a follower fixed to the first member, the sleeve defining a J-slot for receiving the follower. Most preferably the sleeve is rotatable relative to the first and second members such that the change in configuration of the coupling means may be achieved without relative rotation of the first and second members.

According to another aspect of the present invention there is provided a bridge plug for downhole use in which the plug can be set at any desired depth, without relying upon a shoulder on the well, the plug including: a body having axially relatively slidable first and second members, the first member including first locking means; and sealing means, the locking means and sealing means being moveable from respective refractive configurations, to permit the plug to be lowered into a well, into respective radially extended configurations for locking and sealing engagement with a bore wall, extension of the locking means being produced by axial movement of the first member relative to the second member, wherein the first member further comprises engagement means for frictionally engaging the bore wall as the tool is lowered into the well and which provides sufficient grip with the bore wall to hold the first member relative to the bore at the desired depth to permit said relative movement on application on an upward axial force to the second member.

Preferably, the engagement means is in the form of radially spaced and axially oriented leaf springs. The diameter defined by the springs may be selected to frictionally engage the bore wall diameter at the desired depth.

According to a still further aspect of the present invention there is provided a tool for downhole use in and gas wells comprising a hollow body, an inner sleeve slidably mounted within the hollow body and arranged for co-operation with a further tool located within the hollow body and an outer sleeve slidably mounted outside the hollow body. The sleeves are coupled by key means moveable along a keyway extending through the body wall to permit a force applied to the inner sleeve from said further tool to be transferred to the outer sleeve, one of the sleeves being sealingly mounted to the body to provide a pressure seal across the body wall at the keyway.

In use, this arrangement allows forces, typically setting forces, to be transferred from a running tool on the interior of a sealed hollow tool to features such as toothed slips and sealing rings on the exterior of the tool.

The tools of the various aspects of the invention as described above may be used in combination with a running tool for locating the tool in a well and for producing the relative movement of the members to set the tool in the well, the running tool comprising axially-relatively-slidable first and second parts, the first part of the running tool extending through the tool to be set and being releasably coupled to the first member and further releasably coupled to the second member by ratchet means and the second part of the running tool abutting the third member of the tool to be set.

In accordance with a still further aspect of the present invention there is provided a hydraulic tool for downhole use in oil and gas wells comprising a body having a lower end for mounting to a first part of a further tool, a first member slidably mounted in the body and extending from the upper end of the body for connection to a wireline and the like and a second member slidably mounted in the body and extending from the lower end of the body for connection to a second part of the further tool. The first member extends into a first fluid chamber and acts on fluid in the fluid chamber over a first area, the second member extending into a second fluid chamber and acting on fluid in the second fluid chamber over a second area greater than the first area. The chambers are in fluid communication via one-way valve means such that axial movement of the first member relative to the body on application of a first force to the member results in the transfer of fluid between the chambers and the application of a second force greater than the first force to the second member for transfer to the second part of the further tool.

In use, the hydraulic tool allows a connection such as a wireline or slick line to provide a force of greater magnitude than may be applied directly to the wireline or slick line for application to a part of the further tool.

The provision of one-way valve means between the fluid chambers allows the first member to be reciprocated or "stroked" to provide movement of the second member over a greater distance than is provided by a single movement of the first member. Most preferably, a fluid reservoir is provided in communication with one of the fluid chambers via further one-way valve means.

Figures 3, 4:
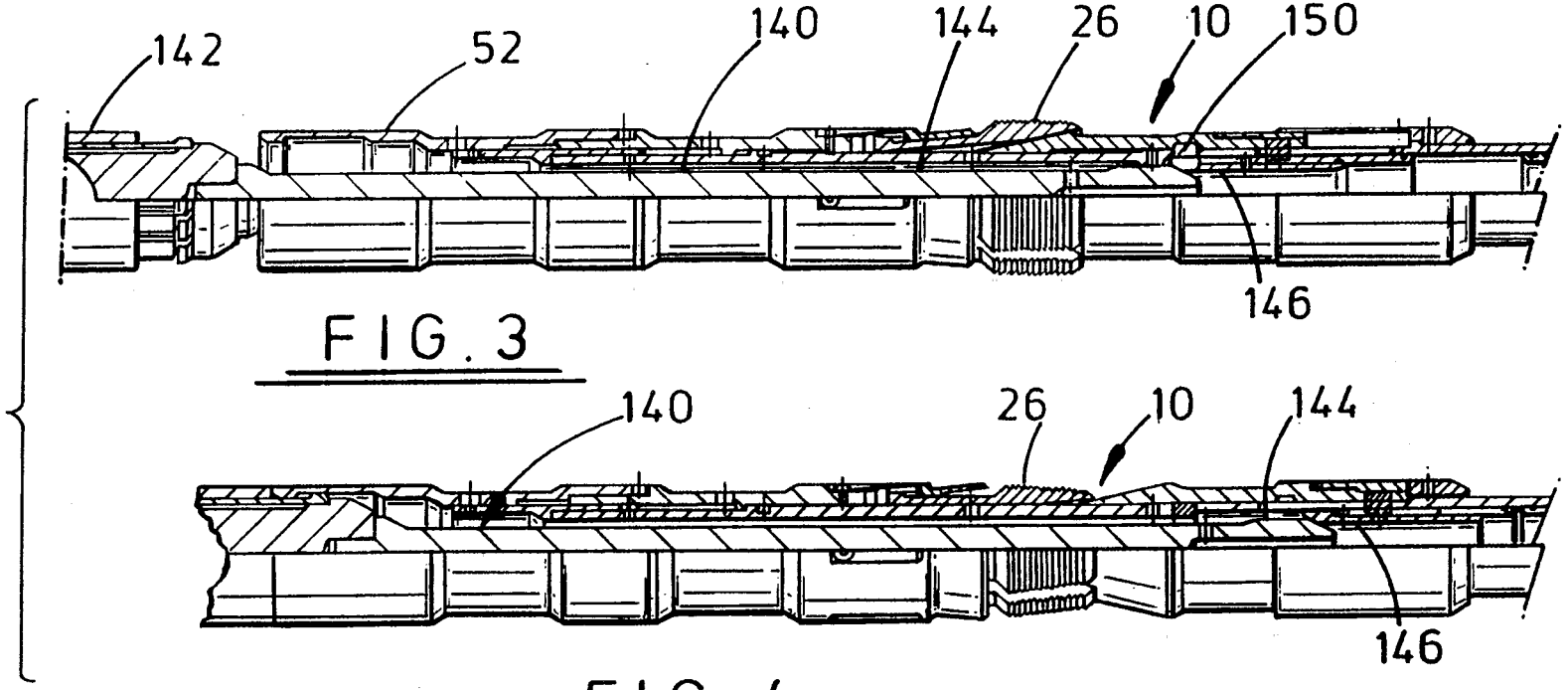
Figure 5:
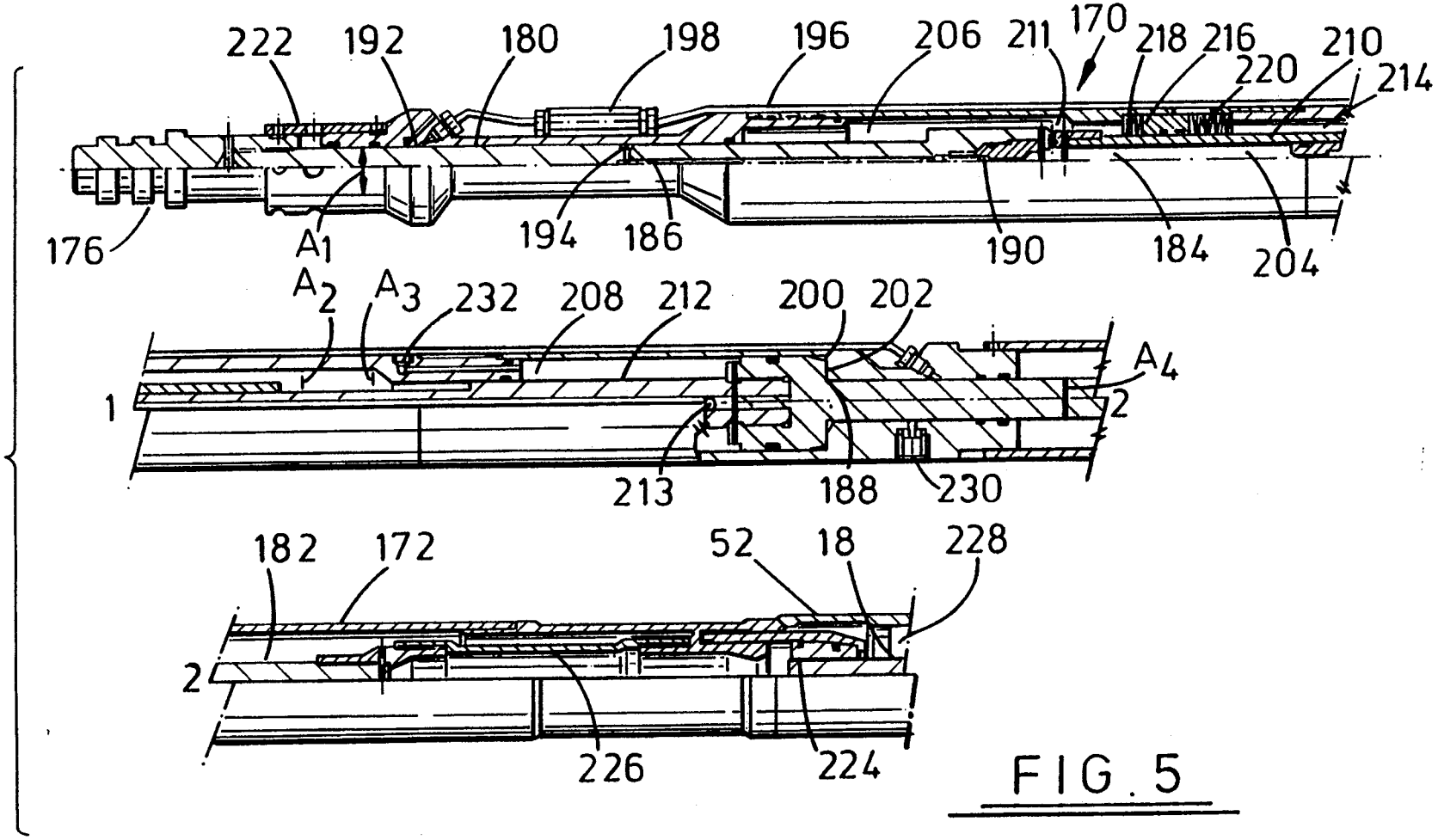

These and other aspects of the present invention will now be described, by way example, with reference to the accompanying drawings, in which:

FIG. 1 (which is split into three portions in the interest of clarity) is a half sectional view of a bridge plug and running tool in accordance with a preferred embodiment of the present invention;

FIG. 2A–2D (which is split into seven portions in the interests of clarity) are half sectional views of the plug and running tool of FIG. 1 shown in greater detail;

FIGS. 3 and 4 are half sectional views of the bridge plug of FIG. 1 and a fishing tool in accordance with a further aspect of the present invention; and FIG. 5 is a sectional view of a running tool in accordance with a further embodiment of the present invention.

Reference is first made to FIG. 1 of the drawings which illustrates a retrievable bridge plug 10 and a running tool 12 in accordance with a preferred embodiment of the present invention. The plug and tool are shown in the configuration for running downhole, the upper ends of the plug 10 and tool 12 being shown to the left hand edge of the drawing sheets. The upper end of the running tool is provided with a standard configuration connection 14 for attachment to the end of a wireline or slick line, and which is also connected to a sleeve 16 and collar 20 which abuts an upper end of the plug 10. The tool 12 further includes an elongate rod 18 which extends co-axially into the hollow plug 10. As will be described, the rod 18 is slidable relative to the sleeve 16 through collar 20 fixed to the lower end of the sleeve 16.

The bridge plug 10 is used to seal a well bore and is therefore provided with an end cap 22 to seal the lower end of the hollow plug and a resilient sealing ring 24 which is radially extended from the retracted configuration, as shown in the drawings, to an extended configuration to provide an exterior seal between the plug and the bore wall. In downhole use the end cap 22 would likely incorporate or be replaced by an equalizing or pump open device to allow for pressure equalization across the plug prior to retrieval. The plug 10 is held at the required depth in the bore by locking means in the form of upper and lower sets of toothed slips 26, 28. The drawing shows the slips in a retracted configuration for running The plug into the well and from which the slips may be radially extended for locking engagement with the bore wall. As will be described, the sealing ring 24 is compressed into sealing engagement with the bore by movement of the slips 26, 28 towards each other by application of a force to the plug 10 by the running tool 12.

Before describing the plug 10 and running tool 12 in detail, the plug setting operation will be briefly described. The plug 10 and running tool 12 are run downhole with the sealing ring 24 and slips 26, 28 in the retracted configuration in which the external diameter of the ring 24 and slips 26, 28 is smaller than the internal bore diameter. However, the plug is provided with engagement means in the form of friction springs 30 which are arranged to frictionally engage the bore wall. On reaching the desired depth the plug and tool 10, 12 are stopped and the running tool 12 is the pulled upwardly a short distance. This reconfigures a coupling arrangement between a first sleeve 32 which carries the lower slips 28 and the friction springs 30 and a second sleeve 34 which carries the sealing ring 24. The reconfigured coupling arrangement permits relative axial movement of the sleeves 32, 34. The second sleeve 34 also carries first and second cam means in the form of upper and lower frusto-conical cam surfaces 36, 38 for movement of the respective slips 26, 28 into the extended configurations. The friction springs 30 tend to retain first sleeve 32 stationary relative to the bore wall. Thus, after reconfiguration of the coupling means provided by the upward movement, the application of a downward force to the plug 10 results in downward movement of the second sleeve relative to the first sleeve 32 resulting in the lower slips 26, riding up the respective cam surfaces 38 into locking engagement with the bore wall. The teeth of the lower slips 28 are configured to lock against downward movement of the slips relative to the bore wall. The plug 10 is thus locked against downward movement though, as will be described, the slips 28 may be released again if it is desired to move the plug 10 to another location in the bore.

The upper slips 26 are mounted on a third sleeve 40 which is initially fixed relative to the second sleeve 34. However, the connection between the sleeves 34, 40 is in the form of a shear pin 42 such that the application of a downward jar to the upper end of the plug 10 by the running tool 12 shears the pin 42 allowing downward movement of the third sleeve 40 relative to the second sleeve 34 such that the upper slips 26 ride up the upper cam surface 36 into locking engagement with the bore wall. The upper slips 26 are configured to resist upward movement over the plug 10 such that the emended sets of slips 26, 28 combine to securely locate the plug in bore.

Compression of the sealing ring 24 is now carried by pulling upwardly on the running tool 12, which upward force is transferred from the sleeve 16 to the rod 18 through the collar 20. The lower end of the rod 18 is releasably coupled, through a shear ring 44, to an internal sleeve 46 which is keyed to the first sleeve 32. As the rod 18 is pulled upwardly and after shearing of shear pin 50 the first sleeve 32 contacts the second sleeve 34, at abutting face 48, to compress the sealing ring 24, the upper end of which is fixed to the second sleeve 34 and the lower end of which is axially slidable on the second sleeve 34. When the compression force being exerted on the sealing ring 24 reaches a predetermined maximum value the shear ring 44 shears to free the rod 18 from the sleeve 46 allowing the running tool 12 to be withdrawn from the bridge plug 10 which is now located in sealing arrangement with the bore wall.

The bridge plug 10 and running tool 12 will now be described in more detail, with reference also to FIG. 2 of the drawings. The second sleeve 34 could be thought as of the main body of the plug 10 with the first and third sleeves 32, 40 being axially slidably mounted thereon. Thus, the second sleeve 34 extends beneath the first sleeve 32 and the end cap 22 is mounted on the lower end of the second sleeve 34. In the running configuration, as shown in the drawings, the upper end of the third sleeve 40, formed of a fishing neck 52 bolted to an upper slip assembly 54 extends just beyond the upper end of second sleeve 34.

The first sleeve carries the lower slips 28 and the friction springs 30. The slips 28 are mounted on a lower slip assembly 56 comprising a sleeve 58 which carries a set of Bellville washers 60 which act against a retainer sleeve 62 which pivotably locates the lower end of the slips 28. Springs 64 are bolted to the sleeve 62 and extend upwardly to engage the slips 28 upwardly of the pivot location to bias the slips 28 into the retracted configuration. As will be described, the Bellville washers 60 act to minimise the force transferred to the slips 26 during compression of the sealing ring 24. The friction springs 30 are located downwardly of the slips 28 between retaining sleeves 66, 68. On running in, the retainer sleeve 62 is held relative to the retaining sleeve 66 by a shear pin 69. The lower end of the sleeve 68 provides a bearing surface 70 utilised during compression of the sealing ring 24, as will be described.

As mentioned above, relative movement between the first and second sleeves 32, 34 is restricted by means of a coupling arrangement which comprises a J-slot or channel 72 in a sleeve 74 located between the first and second sleeves 32, 34 and which is engaged by a follower in the form of a locating screw 76 mounted on the first sleeve 32 and passing through the sleeve 68. The J-slot sleeve 74 is free to rotate relative to the first and second sleeves 32, 34 bun is fixed axially relative to the second sleeve 34 by retaining segments, one of such segments 78 being shown out of position in FIG. 2C, When running the tool down a well the locating screw 76 is located in the shorter leg of the J-slot 72 such that the sleeve 32 may not slide upwardly on the second sleeve 34 and thus the slips 28 remain in the retracted configuration. On reaching the desired location in the well the running tool 12 is used to apply an upward pull to the plug 10. The friction springs 30 hold the first sleeve 32 fixed relative to the bore wall such that the locating screw 76 travels to the lowermost portion of the J-slot 72, the slot 72 being configured such that on subsequent application of a downward force to the plug 10 the locating screw 76 may travel up the longer leg of the J-slot 72 and thus allows the second sleeve 34 to move downwardly relative to the first sleeve 32 and the lower slips 28 to ride up the lower cam surface 38 into locking engagement with the bore wall. The friction springs 30 provide a sufficient grip with the bore wall to hold the first sleeve 32 relative to the bore as the second sleeve 34 is lowered and the lower slips are extended into engagement with the bore wall. The teeth on the slips 28 are configured to resist downward movement relative to the bore wall such that once the slips 28 contact the bore wall they will tend to bite more firmly into the wall on application of further downward force thus fixing the first sleeve 32 more securely in the bore. However, if the operator wishes to release the slips 28 to reposition the plug 10 in the bore this is still possible, the J-slot 72 in the sleeve 74 actually comprises a series of interconnected "J's" such that the subsequent application of an upward force to the second sleeve 34, followed by application of a downward force will position the locating screw 76 in the shorter leg of the next "J" in the slot 72. With the sleeves 32, 34 in this relative position the lower slips 28 are spaced from the cam surface 38 and are thus retracted, permitting further movement of the plug 10 in the bore. The retraction of the slips 28 may be repeated until shearing of the pin 42, which permits relative movement of the second and third sleeves 34, 40 as described in more detail below.

The third sleeve 40 comprises the fishing neck 52 and the upper slip assembly 54 which includes springs 80 for biasing the upper slips 26 towards the retracted position. The third sleeve 40 is initially held fixed relative to the second sleeve 34 by a shear pin 42 which is sheared by applying a downward jar to the upper end of the plug. The third sleeve 40 is then pushed downwardly over the second sleeve 34.such that the upper slips 26 ride over the upper cam surface 36 into locking engagement with the bore wall. The outer surface of the upper end of the second sleeve 34 is provided with circumferential grooves 82 which cooperate with a ratchet segment 84 located between the fishing neck 52 and the upper slip assembly 54. Thus, the third sleeve 40 is held relative to the second sleeve 34 with the upper slips 26 in the extended configuration. The teeth of the slips 26 are arranged to resist relative upward movement such that the plug 10 is now held tightly within the bore.

As was mentioned above, compression of the sealing ring 24 is provided by applying a compressive force to the second sleeve 34 through the first sleeve 32. The upward force is applied to the plug 10 from the rod 18 of the running tool 12 to the inner seal-off sleeve 46 mounted within the second sleeve 34. The seal-off sleeve 46 is provided with upper and lower seals 86, 88 (FIG. 2D) which permits sliding sealing engagement between the outer face of the sleeve 46 and the inner face of the second sleeve 34. Fixed to the seal-off sleeve 46 are a plurality of load transfer keys 90 which extend through axial keyways 92 in the second sleeve 34 to a load transfer sleeve 94 mounted on the exterior of the lower end of the second sleeve 34. A shear screw 50 releasably connects the sleeve 94 to the second sleeve 34, which screw 50 is sheared by application of a light upward jar to the rod 18 via the collar 20 and sleeve 16, the lower end of the rod being attached to the seal-off sleeve 46 by the shearing ring 44. Upward movement of the running tool 12 brings an upper bearing surface 98 of the load transfer sleeve 94 into contact with the downwardly facing bearing surface 70 of the lower slip assembly 56. The upward force applied by the rod 18 is now thus applied from the load transfer sleeve 94 to the slip assembly sleeve 58 and directly from an upper abutting face 100 of the sleeve 58 onto an opposing abutting face 48 formed at the base of the lower cam surface 38. The cam surface 38 forms part of a cam assembly 104 including a sleeve 106 mounted over a tensioning spring 108. The upper end of the spring 108 bears against a spacer ring 109 and a lower anti-extrusion ring 110 which forms a lower retainer for the resilient sealing ring 24. A similar ring 112 is provided at the upper edge of a sealing ring 24 but is fixed relative to the second sleeve 34. Thus, the sealing ring 24 may be compressed by upward movement of the lower ring 110 and pushed into sealing engagement with the bore wall.

In the illustrated embodiment the upward force on the rod 18 is provided by a jarring action between an upper face 120 (FIG. 2B) of the collar 20 and a lower face 122 of an end fitting 124 on the upper end of the rod 18. Thus, the sealing ring 24 will be compressed in a series of steps. To prevent expansion of the sealing ring 24 between jars, a ratchet assembly 126 is mounted to the upper end of the second sleeve 34 for engaging a corresponding toothed portion 128 extending axially over a portion of the rod 18.

As the sealing ring 24 is compressed and the lower slips 28 are pushed up the bore wall the spring washers 60 serve to limit the force transferred to the slips 28, allowing more efficient transfer of force between the sleeve 58 and the cam assembly 104. Also, the spring washers 60 permit a small degree of retraction of the slips 28 on upper movement of the slip assembly 56, facilitating compression of the sealing ring 24. Compression of the sealing ring 24 continues until the reaction force produced by the sealing ring 24 and the tensioning spring 108 reach a predetermined threshold and any further application of force results in shearing of the ring 44 and release of the rod 18 from the seal-off sleeve 46. Continued movement of the rod 18 upwardly through the plug 10 then causes shearing out of the ratchet assembly 126 by a ratchet stop 130 fixed to the rod 18 at the lower end of the tooth portion 128. The running tool 12 thus may be lifted to the surface leaving the bridge plug 10 in place. The plug 10 is held in position in the bore by the action of the compressed sealing ring 24 and tensioning ring 108 which maintain a tension between the slips 26, 28 and maintain the slips 26, 28 in engagement with the bore wall.

Retrieval of the bridge plug 10 is achieved using a fishing tool 140 as illustrated in FIGS. 3 and 4 of the drawings. The fishing tool 140 comprises a conventional fishing head 142 and a prong 144 which extends into the interior of the plug 10 and has a lower end portion sized to knock a release sleeve 146 into a position which allows relative axial sliding movement between two elements of the sleeve 34. The release sleeve 146 is shown most clearly in FIG. 2B. The upper cam surface 36 is formed on a cam sleeve 148 which is locked relative to the second sleeve 34 by a locking segment 150 extending through an annular slot 152 in the second sleeve 34 and which is held in place by the upper end of the release sleeve 146. The lower end of the cam sleeve 148 includes a plurality of keys 154 which extend through keyways 156 in the second sleeve 34 to a sleeve 158 in engagement with the inner wall of the second sleeve and extending across the keyways 156. The release sleeve 146 and the sleeve 158 are releasably interconnected by means of a shear pin 160 which is sheared when the upper face of the release sleeve 146 is jarred by the lower end of the prong 144. FIG. 3 of the drawings shows the prong 144 in contact with the release sleeve 146. Further downward movement of the prong 144 thus pushes the cam sleeve 148 downwardly to the position shown in FIG. 4 such that the locking segment 150 is moved radially inwardly and the cam sleeve 148 is then free to move downwardly relative to the second sleeve 34 such that the upper slips 26 are retracted by the action of the springs 80. With the upper slips 26 retracted a pull on the fishing tool, the head 142 of which has now engaged the fishing neck 52, results in upward movement of the second sleeve 34 relative to the first sleeve 32 such that the sealing ring 24 is extended and comes out of engagement with the bore wall and also in movement of the lower cam surfaces 38 upwardly relative to the lower slips 28 such that the skips 28 return to the retracted configuration. The plug 10 may then be withdrawn by lifting the fishing tool 140.

An alternative means of releasing the sleeve 146 involves the use of a ball dropped down the bore into the tool to engage the upper end of the sleeve 146. The application of hydraulic pressure to the bore then results in downward movement of the sleeve 146 as described above. This method offers the advantage that a conventional fishing tool (without probe) may be used to retrieve the tool, bun requires that the sleeve 158 is in sealing engagement with the inner wall of the second sleeve.

The bridge plug 10 as described above may be run in using various different forms of running tool and a further running tool 170 is shown in FIG. 5 of the drawings. The running tool 170 operates hydraulically, and like the running tool 12 described above, is provided with a sleeve 172 at a lower end for abutting the upper end of the plug 10 and a collar 174 arranged to engage a suitable rod 18. The upper end of the tool is provided with a standard wireline or slick line connection 176. A first member 180 is axially slidable relative to the body of the tool 178, extending from the upper end of the body and being provided with the connection 176. At the lower end of the body 178 a second member 182, also axially slidable in the body, extends through the sleeve 172 and is fitted with the collar 174.

In broad terms, the first member 180 provides a first piston which draws fluid from a reservoir 184 and then pumps the fluid from a first chamber 186 into a second chamber 188 which acts on a relatively large piston area formed on the second member 182. The relative sizes of piston area allows a relatively small force applied to the first member 180 to be transformed into a relatively large force to be applied to the second member 182 and to the rod of the running tool.

The first chamber 186 is in communication with the reservoir 184 via a check valve 190 and fluid is pushed from the reservoir 184 into the first chamber 186 on a downward movement of the first member 180 relative to the body 178. The first chamber 186 is defined by side walls formed by an inner wall of the body 178 and an outer wall of the first member 180 and opposing annular piston faces 192, 194. Upward movement of the first member 180 and a reduction in volume of the first chamber 186 results in fluid being pumped through an external control line 196, provided with a check valve 198 into the second chamber 188, defined by an inner wall of the body 178, an outer wall of the second member 182 and opposing annular piston faces 200, 202 of a substantially greater area Than The faces 192, 194, such that the force acting on The second member 182 is substantially greater Than The force applied to the first member 180.

Clearly, movement of The first member 180 will only produce a relatively small axial movement of The second member 182 such that the first member 180 has to be moved up and down, or "stroked" a number of times to provide a significant movement of the second member 182. However, the arrangement does provide for The application of a substantial force to the second member 182 for application of only a relatively small force to the first member 182, such as could readily be applied by means of a wireline or slick line.

Further details of the tool 170 will now described. The hydraulic fluid reservoir 184 comprises a number of communicating chambers: a central chamber 204; an upper annular chamber 206; and a lower annular chamber 208. The check valve 190 is in direct communication with the central chamber 204. The valve 190 is located between the lower end of the first member 180 and a sleeve 210 which is pinned to the member 180 and defines the upper outer wall of the central chamber 204. The lower outer wall of the chamber 204 is defined by a hollow rod pinned 212 to the upper end of the second member 182 and which is slidable within the sleeve 210. The upper annular chamber 206 is defined by an inner face of the body 178 and outer faces of the first member 180 and sleeve 210 and communicates with the chamber 204 via a passage 211 in the sleeve 210. The lower annular chamber 208 is defined by an inner face of the body 178 and an outer face of the rod 212 and communicates with the chamber 204 via a passage 213 in the rod 212. Between the chambers 206, 208 is a further annular chamber 214 which is open to well pressure. To avoid the possibility of lock up between the parts of the tool an expansion compensator, in the form of an annular piston 216 mounted between sees of Bellville washers 218, 220 is provided between the chambers 206, 214.

When running down the well the first member 180 is held fixed relative to the body 178 by a pinned sleeve 222 which may be released by jarring down on the tool 170.

Once setting of the plug 10 has commenced, the compression of the plug 10 which occurs on setting the slips 26, 28 is accommodated by a ratchet assembly 224, provided on a sleeve 226 pinned to the lower end of the second member 182, which engages a toothed portion 228 extending axially down the rod 18.

In the event that the running tool 170 cannot be released from the plug 10, it may be necessary to utilise a jar tool to provide the force necessary to release the shear ring 44. To avoid the cushioning effect that would be produced by hydraulic fluid between the body 178 and the second member 182 burst discs 230, 232 are provided to allow the hydraulic fluid to be expelled from the second chamber 188 and the lower annular chamber 208. With the fluid expelled from the chambers the piston faces 200, 202 may be brought together to allow a solid jar to be applied through the tool 170.

In view of the external pressures which the tool 170 will be subject to all piston areas into and out of each part of the tool 170 are equal such that any differential pressure acting on the tool effectively cancels itself out, and it will be noted that the areas A1, A2, A3 and A4 are equal.

From the above description it will be clear that the present invention provides a tool, and in particular a retrievable bridge plug, which may be conveniently set utilising a conventional wireline or slick line and in pipe strings without landing nipples. With appropriate modifications, elements of the plug may also be utilised in plugs or other tools which are set using hydraulic lines or charges detonated by electric line. It will further be obvious to those of skill in the arc that various modifications and improvements may be made to the tools as described and illustrated herein without departing from the scope of the present invention.

I claim:

1. A tool for downhole use in oil and gas wells comprising: a body having first and second locking means moveable between a retracted configuration to permit movement of the tool through a bore and a radially extended configuration for locking engagement with a bore wall, the first locking means being mounted on a locking assembly via biasing means; a resilient ring member between the locking means and compressible into sealing engagement with a bore wall by relative axial movement of the locking means towards each other and at least the first locking means being moveable axially on the body to provide compression of the ring member; and cam means between the ring member and the first locking means for extending the first locking means from the retracted configuration into the extended configuration, the setting force to compress the ring member into engagement with the bore wall being applied via the locking assembly and the cam means, the proportion of said setting force transmitted to said first locking means being limited by said biassing means.

2. A tool for downhole use in oil and gas wells comprising: a body having first and second locking means moveable between a retracted configuration to permit movement of the tool through a bore and a radially extended configuration for locking engagement with a bore wall; a resilient ring member located between the locking means and compressible into sealing engagement with a bore wall by relative axial movement of the locking means towards each other; first and second cam means mounted on the body between the ring member and the respective locking means for extending the respective locking means from the retracted configuration into the extended configuration on axial movement of the locking means towards the ring member; and release means arranged for engagement with a fishing tool and operable thereby to permit movement of the second cam means relative to the second locking means sufficient to permit said second locking means to retract from the extended configuration and to permit expansion of the ring member out of sealing engagement with the bore wall.

3. The tool of claim 2, wherein resilient means are provided for biassing the cam means axially towards the respective locking means and thus maintaining the locking means in the extended configuration.

4. The tool of claim 2, wherein the body is hollow and the release means includes a connecting member between said second cam means and the body and a connecting member retainer releasably mounted on the interior of the body for release from the body by the fishing tool to allow movement of the connecting member to permit relative movement between the second cam means and the body.

5. The tool of claim 4, wherein the connecting member retainer is a sleeve formed of inner and outer releasably interconnected relatively-axially-slidable parts, the outer part engaging the connecting member and the inner part being coupled to the cam means by key means moveable along a keyway extending through the body wall.

6. The tool of claim 4 in combination with a fishing tool for releasing and retrieving the tool from a well, the fishing tool including a prong for releasing the connecting member retainer and a fishing profile for engaging a corresponding fishing neck provided on the body.

7. The tool of claim 4 in combination with a release ball and fishing tool for releasing and retrieving the tool from a well, the release ball being sized to sealingly engage the connecting member retainer to allow application of hydraulic pressure above the ball to release the retainer, and the fishing tool including a fishing profile for engaging a corresponding fishing neck provided on the body.

8. The tool of claim 1, wherein the body comprises first, second and third members;

the first locking means and a locking assembly being mounted to the first member, the resilient ring member and cam means being mounted to the second member, and the second locking means being mounted to the third member, wherein the second member is axially moveable in a first direction relative to the first member on application of an axial force to the second member to extend the first locking means into engagement with the bore wall, the third member is axially moveable in said first direction relative to the second member on application of an axial force to the third member to extend the second locking means into engagement with the bore wall, and the first member is axially moveable in a second direction relative to the second member on application of an axial force to the first member to compress the sealing ring into sealing engagement with the bore wall.

9. The tool of claim 8, wherein the first member includes engagement means for frictionally engaging a bore wall as the tool is lowered down a well and the tool further comprises coupling means interconnecting the first and second members, the coupling means having a first configuration for use when lowering the tool into a well in which relative movement in said first direction between the first and second members is prevented and a second configuration in which said relative movement is permitted, the engagement means providing sufficient grip with the bore wall when the tool has reached a desired depth in the well to hold the first member relative to the bore to permit said relative movement on application of a force to said second member, movement of the coupling means from the first configuration to the second configuration being produced by axial movement of the second member in said second direction relative to the first member.

10. The tool of claim 8, wherein the second and third members are releasably interconnected to prevent movement therebetween prior to extension of the first locking means.

11. The tool of claim 8, wherein the second and third members are further interconnected by ratchet means for locking the third member relative to the second member and thereby lock the second locking means in the extended configuration on movement of the third member in said first direction relative to the second member.

12. The tool of claim 8, wherein the tool is hollow and the first member includes an outer sleeve slidably mounted externally of the second member and an inner sleeve slidably mounted internally of the second member, the second member defining a wall for isolating the interior of the tool, the outer and inner sleeves being coupled by key means moveable along a keyway extending through the wall to permit a force in said second direction applied to the inner sleeve by a running tool to be transferred to the outer sleeve, one of the sleeves being sealingly mounted to the second member to provide a pressure seal across the second member at the keyway.

13. The tool of claim 12, wherein the inner sleeve is sealingly mounted to the second member.

14. The tool of claim 12, wherein the outer sleeve is in two parts, an upper part having the first locking means and the engagement means and a lower part coupled to the inner sleeve, the lower part being initially releasably interconnected with the second member and spaced from the upper part to permit relative axially sliding movement therebetween for extension of the first locking means.

15. The tool of claim 8, in combination with a running tool for locating the tool in a well and producing said relative movement of the members to set the tool in the well, the tool comprising axially-relatively-slidable first and second parts, the first part of the running tool for extending through the tool and being releasably coupled to the first member and further releasably coupled to the second member by ratchet means and the second part of the running tool for abutting the third member.

16. A tool for downhole use in oil and gas wells comprising:

axially-relatively-slidable first and second members, the first member having engagement means for frictionally engaging a bore wall as the tool is lowered down a well and locking means moveable between a retracted configuration and a radially extended configuration for locking engagement with a bore wall to restrict movement of the first member relative thereto at least in a first direction, the second member having cam means for extending said locking means from said retracted configuration on axial movement of the second member in said first direction relative to the first member; and coupling means interconnecting the first and second members, the coupling means having a first configuration for use when lowering the tool into a well in which relative axial movement in said first direction between the first and second members is prevented and a second configuration in which said relative axial movement is permitted, the engagement means providing sufficient grip with the bore wall when the tool has reached a desired depth to hold the first member relative to the bore to permit said relative movement on application of a force in said first direction to said second member, movement of the coupling means from the first configuration to the second configuration being produced by axial movement of the second member relative to the first member in a second direction.

17. The tool of claim 16, including means actuable to seal the bore to provide a bridge plug.

18. The tool of claim 16, wherein the coupling means includes:

a sleeve located between the first and second members and axially fixed relative to the second member; and a follower fixed to the first member, the sleeve defining a J-slot for receiving the follower.

19. The tool of claim 18, wherein the sleeve is rotatable relative to the first and second members.

20. A bridge plug for downhole use in which the plug can be set at any desired depth, without relying upon a shoulder on the well, the plug including: a body having axially-relatively-slidable first and second members, the first member including first locking means; and sealing means mounted on the body, the locking means and the sealing means being movable from respective retracted configurations, to permit the plug to be lowered into a well, to radially extended configurations for respectively locking and sealing with a bore wall, extension of the locking means being produced by axial movement of the first member relative to the second member in a first direction, wherein the first member further comprises engagement means for frictionally engaging the bore wall as a tool is lowered into the well and which provides sufficient grip with the bore wall to hold the first member relative to the bore at the desired depth to permit said relative movement on application of an axial force in a second direction to the second member.

21. A tool for downhole use in oil and gas wells comprising:

a hollow body;

an inner sleeve slidably mounted within the hollow body; and an outer sleeve slidably mounted outside the hollow body, the sleeves being coupled by key means moveable along a keyway extending through the body wall and one of the sleeves being sealingly mounted to the body to provide a pressure seal across the body wall at the keyway, and the inner sleeve being arranged for co-operation with a further tool located within the hollow body for applying a force to the inner sleeve, which is transferred to the outer sleeve through the key means.

* * * * *

UNITED STATES PATENT AND TRADEMARK OFFICE

CERTIFICATE OF CORRECTION

PATENT NO. : 5,366,010

DATED : November 22, 1994

INVENTOR(S) : Klaas J. Zwart

It is certified that error appears in the above-identified patent and that said Letters Patent is hereby corrected as shown below:

ON THE COVER PAGE:

Under References Cited, add the following:

U.S. PATENT DOCUMENTS

| | | |
|---|---|---|
| 2,595,014 | 4/1952 | Smith et al. |
| 2,747,673 | 5/1956 | Lawrence |
| 2,747,781 | 5/1956 | Schofield |
| 2,756,827 | 7/1956 | Farrar |
| 2,901,046 | 8/1959 | Webber |
| 3,199,906 | 8/1965 | Chenoweth |
| 3,356,142 | 12/1967 | Crow et al. |
| 3,374,840 | 3/1968 | Current |
| 3,631,924 | 1/1972 | McGill |
| 3,991,826 | 11/1976 | Baugh |
| 4,156,460 | 5/1979 | Crowe |
| 4,300,636 | 11/1981 | Lawrence |
| 4,307,781 | 12/1981 | Preston, Jr. et al. |
| 4,627,491 | 12/1986 | Zunkel |
| 4,635,716 | 1/1987 | Zunkel |

FOREIGN DOCUMENTS

| | | |
|---|---|---|
| 2,160,241 | 12/1985 | United Kingdom |
| 2,200,388 | 8/1988 | United Kingdom |

IN THE SPECIFICATION:

Column 2, line 22, "De" should be -- be --.

Column 2, line 65, "to" should be -- of --.

UNITED STATES PATENT AND TRADEMARK OFFICE

CERTIFICATE OF CORRECTION

PATENT NO. : 5,366,010

DATED : November 22, 1994

INVENTOR(S) : Klaas J. Zwart,

It is certified that error appears in the above-indentified patent and that said Letters Patent is hereby corrected as shown below:

Column 3, line 47, after "relative" insert -- to --.

Column 3, line 53, after "the" (second occurrence) at the end of the line, insert -- tool --.

Column 4, line 17, "refractive" should be -- retractive.

Column 4, line 36, after "in" at the end of the line, insert -- oil --.

Column 6, line 5, "The" should be -- the --.

Column 6, line 56, "emended" should be -- extended --.

Column 6, line 57, at the end of the line after "in" insert -- the --.

Column 6, line 59, after "carried" insert -- out --.

Column 7, line 6, "located" should be -- locked --.

Column 7, line 45, "bun" should be -- but --.

Column 7, line 47, after "2C" the comma (,) should be a period (.).

UNITED STATES PATENT AND TRADEMARK OFFICE

CERTIFICATE OF CORRECTION

PATENT NO. : 5,366,010

DATED : November 22, 1994

INVENTOR(S) : Klaas J. Zwart

It is certified that error appears in the above-indentified patent and that said Letters Patent is hereby corrected as shown below:

Column 8, line 6, after "possible" the comma (,) should be a semicolon (;).

Column 8, line 26, after "34" omit the period (.).

Column 10, line 8, "skips" should be -- slips --.

Column 10, line 18, "bun" should be -- but --.

Column 10, line 59, "Than The" should be -- than the --.

Column 10, line 60, "The" should be -- the --.

UNITED STATES PATENT AND TRADEMARK OFFICE

CERTIFICATE OF CORRECTION

PATENT NO. : 5,366,010
DATED : November 22, 1994
INVENTOR(S) : Klaas J. Zwart

It is certified that error appears in the above-indentified patent and that said Letters Patent is hereby corrected as shown below:

Column 10, line 61, "Than The" should be -- than the --.

Column 10, line 63, "The" should be -- the --.

Column 10, line 64, "The" should be -- the --.

Column 11, line 1, "The" should be -- the --.

Column 11, line 28, "sees" should be -- sets --.

Column 11, line 65, "arc" should be -- art --.

Signed and Sealed this

Twenty-first Day of February, 1995

*Attest:*

Bruce Lehman

BRUCE LEHMAN

*Attesting Officer*

*Commissioner of Patents and Trademarks*